US005141811A

United States Patent [19]

Kawakami et al.

[11] Patent Number: 5,141,811

[45] Date of Patent: Aug. 25, 1992

[54] ELASTIC SYNTHETIC POLYMER FILAMENT WITH MULTI-LOBATED CROSS-SECTIONAL PROFILE

[75] Inventors: Kenji Kawakami, Matsuyama; Hiroyuki Nagai, Ehime; Masakazu Fujita, Ikoma, all of Japan

[73] Assignee: Teijin Limited, Osaka, Japan

[21] Appl. No.: 616,438

[22] Filed: Nov. 21, 1990

[30] Foreign Application Priority Data

Dec. 1, 1989 [JP] Japan ..... 1-312691

[51] Int. Cl.[5] ..... D02G 3/00

[52] U.S. Cl. ..... 428/364; 428/374; 428/373; 428/397

[58] Field of Search ..... 264/177.1, 177.13; 428/374, 364, 373, 397

[56] References Cited

U.S. PATENT DOCUMENTS 3,418,200 12/1968 Tanner ..... 264/177.13
3,914,488 10/1975 Gorrafa ..... 264/177.13
4,791,026 12/1988 Yoshimoto et al. ..... 428/374

FOREIGN PATENT DOCUMENTS 0223702 3/1987 European Pat. Off. .
2125920 6/1972 France .
1351057 1/1972 United Kingdom .

*Primary Examiner*—Patrick J. Ryan
*Assistant Examiner*—N. Edwards
*Attorney, Agent, or Firm*—Burgess, Ryan & Wayne

[57] ABSTRACT

An elastic synthetic polymer filament having a multi-lobated cross-sectional profile is composed of (A) a filamentary axial constituent extending along the longitudinal axis of the filament, and (B) 3 to 8 filamentary lobe constituents radically protruding from and extending along the filamentary axial constituent each having a constricted portion thereof through which each filamentary lobe constituent is connected to the filamentary axial constituent, the cross-section of the filament satisfying the relationship (I):

$$1.3 \leqq d_1/w \leqq 10 \quad \text{(I)}$$

wherein $d_1$ is a largest cross-sectional width of each filamentary lobe constituent (C).

4 Claims, 3 Drawing Sheets

ELASTIC SYNTHETIC POLYMER FILAMENT WITH MULTI-LOBATED CROSS-SECTIONAL PROFILE

BACKGROUND OF THE DISCLOSURE

1) Field of the Invention

The present invention relates to an elastic synthetic polymer filament with a multi-lobated cross-sectional profile and comprising a thermoplastic elastomer. More particularly, the present invention relates to an elastic synthetic polymer filament with a multi-lobated cross-sectional profile, comprising a thermo-plastic elastomer and having an enhanced resistance to breakage by a sewing needle and a high resistance to photo-deterioration and chlorine-deterioration.

2) Description of the Related Arts

It is known that various thermoplastic elastomers, for example, polyurethane resins and polyetherester block copolymer resins, are utilized for forming elastic filaments. These conventional elastic filaments are advantageous in having a high elastic recovery but are disadvantaged by a poor resistance to photo-deterioration and chlorine-deterioration.

Various attempts have been made to eliminate the above-mentioned disadvantages; for example, Japanese Examined Patent Publication No. 52-22,744 and Japanese Unexamined Patent Publication No. 62-192,450 disclose that the conventional thermoplastic elastomer is mixed with a protective additive consisting of an ultraviolet ray-absorbant or antioxidant, for example, a hindered phenol compound, a benzotriazol compound, a salicylic acid ester compound or titanium dioxide. These attempts, however, have not provided a satisfactory improvement, and thus are not practically utilized for the following reasons.

When the conventional elastic filaments are used in the form of a multifilament yarn, the resultant elastic multifilament material, for example, swim wear, exhibits a poor resistance to ultraviolet ray-deterioration and an unsatisfactory resistance to chlorine-deterioration. In the multifilament yarn materials, it is known that the smaller the denier of the individual filaments, the poorer the resistance to the above-mentioned deterioration (lowering of the mechanical strength). Therefore, the use of the conventional elastic multifilament yarn materials is strictly restricted to a specific scope.

When the conventional elastic filaments are used in the form of a monofilament yarn, the resultant elastic monofilament yarn materials have a higher resistance to the above-mentioned deterioration than that of the conventional elastic multifilament yarn materials, but when the elastic monofilament yarns are used for the production of a woven or knitted fabric, the resultant product has an undesirably high stiffness and hard touch, and when sewed by a sewing machine, the elastic monofilament yarns are easily broken by a sewing needle, and thus ground yarns, in which the elastic monofilament yarns are contained as an element, are frequently broken. Therefore, in practice, the utilization of the conventional elastic monofilament yarn is limited.

SUMMARY OF THE INVENTION

An object of the present invention is to provide an elastic synthetic polymer filament with a multi-lobated cross-sectional profile, comprising a thermoplastic elastomer, and having a high resistance to ultraviolet ray-deterioration and chlorine-deterioration.

Another object of the present invention is to provide an elastic synthetic polymer filament with a multi-lobated cross-sectional profile, comprising a thermoplastic elastomer and useful for forming an elastic fabric having a satisfactory softness and elasticity.

The above-mentioned objects can be attained by imparting a multi-lobated cross-sectional profile to an elastic synthetic polymer filament.

Namely, the elastic synthetic polymer filament with a multi-lobated cross-sectional profile of the present invention comprises a thermoplastic elastomer and is composed of (A) a filamentary axial constituent extending along the longitudinal axis of the filament; (B) 3 to 8 filamentary lobed constituents radially protruding from and extending along the filamentary axial constituent; and each having a constricted portion thereof through which each filamentary lobe constituent is connected to the filamentary axial constituent, the multi-lobated cross-sectional profile of the filament satisfying the relationship (I):

$$1.3 \leqq d_1/w \leqq 10 \quad \text{(I)}$$

wherein $d_1$ represents a largest cross-sectional width of the filamentary lobe constituents (B) and w represents a smallest cross-sectional width of the constricted portions of the filamentary lobe constituents (B).

DESCRIPTION OF THE PREFERRED EMBODIMENTS

Figure 1A:
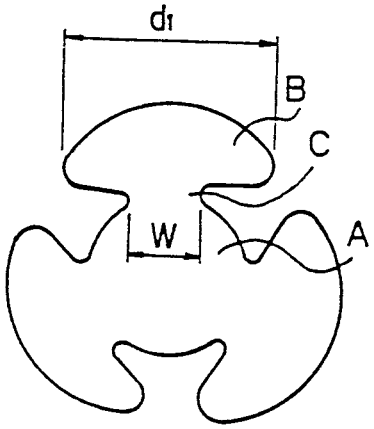
FIGS. 1A to 1F, respectively, show a cross-sectional profile of an embodiment of the elastic synthetic polymer filament of the present invention.
Figure 1B:
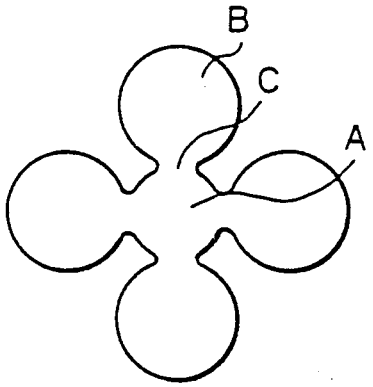

The elastic synthetic polymer filament of the present invention having a multi-lobated cross-sectional profile of the present invention comprises a thermoplastic elastomer.

The thermoplastic elastomer usable for the present invention is a fiber-forming thermoplastic elastomer usually having a melting point of from 180° C. to 240° C., and is preferably selected from polyurethane elastomers, polyester elastomers, and polyamide elastomers.

The polyurethane elastomers include reaction products of at least one member selected from the group consisting of polyesters and poly(oxyalkylene)glycols containing terminal hydroxyl groups and having a molecular weight of from 1,000 to 3,000, with a diisocyanate compound, a chain extender consisting of at least one member selected from the group consisting of glycol compounds and diamine compounds, and optionally, a polycarbonate compound containing terminal hydroxyl group.

The polyesters usable for the production of the above-mentioned polyurethane elastomers are preferably selected from polyesterification products of a dicarboxylic acid component comprising at least one member selected from adipic acid and sebacic acid with a diol component comprising at least one member selected from ethylene glycol, butylene glycol, and diethylene glycol. Also, the above-mentioned poly(oxyalkylene) glycols are preferably selected from poly(oxyethylene) glycol, poly(oxypropylene)glycol, poly(oxybutylene) glycol, and block and random copolymers of the above-mentioned homopolymers.

The above-mentioned diisocyanate compound is preferably selected from 2,4-tolylene diisocyanate, diphenylmethane-4,4'-diisocyanate and dicyclohexyl-4,4'-diisocyanate.

The above-mentioned chain-extender preferably comprises at least one member selected from ethylene glycol, propylene glycol, 1,4-$\beta$-hydroxyethoxybenzene, ethylene diamine, butylene diamine, and propylene diamine.

The above-mentioned polycarbonate, which is optionally used for the production of the polyurethane elastomers, is preferably selected from polymerization products of bis-phenol A with phosgene or diphenyl carbonate and have terminal hydroxyl groups.

The polyester elastomers usable for the present invention are preferably polyetherester block copolymers which are polycondensation products of a dicarboxylic acid component comprising mainly terephthalic acid, with a diol component comprising mainly 1,4-butane diol and a polyol component comprising mainly a poly(oxyalkylene) glycol having a molecular weight of 400 to 4,000.

The polyamide elastomers usable for the present invention are preferably copolymers of lauryl lactam with a poly(oxybutylene)glycol and dicarboxylic acid, for example, terephthalic acid. The rigidity of the polyamide elastomers is variable depending on the molecular weight of the poly(oxyalkylene)glycol and the proportion of the lauryl lactam in the elastomer.

When the elastic synthetic polymer filament is required to have a high resistance to alkali, chlorine, wet-heating or dry-heating, the thermoplastic elastomer is preferably selected from polyester elastomers, especially polyetherester block copolymer elastomers.

The polyetherester block copolymer elastomers will be further explained in detail below.

A preferable polyetherester block copolymer is selected from polycondensation products of a dicarboxylic acid component comprising at least 80 molar %, more preferably at least 90 molar % of terephthalic acid or a ester-forming derivative thereof and 20 molar % or less, more preferably 10 molar % or less of another dicarboxylic acid, with a low molecular weight diol component comprising at least 80 molar %, more preferably 90 molar % of 1,4-butanediol or an ester-forming derivative thereof and 20 molar % or less, more preferably 10 molar % or less an other diol compound, and a poly (oxyalkylene) glycol having a molecular weight of 400 to 4,000, more preferably 600 to 3,500.

The dicarboxylic acids other than the terephthalic acid and usable for the dicarboxylic acid component can be selected from aromatic dicarboxylic acids, for example, isophthalic acid, phthalic acid, 2,6-naphthalene dicarboxylic acid, 2,7-naphthalene dicarboxylic acid, bis(p-carboxyphenyl) methane and 4,4'-diphenylether dicarboxylic acid; aliphatic dicarboxylic acids, for example, adipic acid, sebacic acid, azelaic acid and dodecane dicarboxylic acid; cycloaliphatic dicarboxylic acids, for example, 1,4-cyclohexane dicarboxylic acid; and ester-forming derivatives of the above-mentioned acids.

The low molecular weight diol compounds other than 1,4-butane diol and usable for the diol component are preferably selected from ethylene glycol, 1,3-propane diol, 1,5-pentane diol, 1,6-hexane diol, diethylene glycol, 1,4-cyclohexane diol and 1,4-cyclohexane dimethanol.

The above-mentioned poly(oxyalkylene)glycol usable for the preparation of the polyetherester block copolymers are preferably selected from poly(oxyethylene)glycols, poly(oxypropylene)glycols, poly(oxybutylene)glycol, and random copolymers and block copolymers and mixtures of two or more of the above-mentioned homopolymers, more preferably poly(oxybutylene)glycol homopolymers.

Preferably, the poly(oxyalkylene)glycol has an average molecular weight of 400 to 4,000.

When the average molecular weight is less than 400, the resultant polyetherester block copolymer sometimes has an unsatisfactory block polymerization structure, and thus exhibits an unsatisfactory elastic property. Also, the resultant polyetherester block copolymer has a lower melting point, and thus the resistances of the copolymer to dry heating and wet-heating are sometimes lowered.

If the molecular weight is more than 4,000, the resultant copolymer is sometimes phase-separated, and thus does not become a block copolymer and exhibits a poor elastic property.

Preferably, the poly(oxyalkylene)glycol component in the polyetherester block copolymer is present in a content of 50 to 80% by weight.

When the content of the poly(oxyalkylene)glycol is more than 80% by weight, the resultant elastomer has a very low melting point, and thus the resultant elastic filament is disadvantageous in that, when subjected to a dry heat treatment or wet heat treatment, the elastic property of the treated filament is suddenly reduced and it exhibits a poor durability, although this filament has a high elastic property before the heat treatment. Also when the content of the poly(oxyalkylene)glycol is less than 50% by weight, the resultant filament exhibits a large permanent stress and a poor elastic property.

The thermoplastic elastomer usable for the present invention optionally contains an additive consisting of at least one member selected from ultraviolet ray-absorbers and antioxidants, to enhance the resistances thereof to ultraviolet rays and thermal oxidation. The antioxidant is preferably selected from hindered phenol compounds, hindered amine compounds and sulfur atom-containing ester compounds. Also, the ultraviolet ray-absorber is preferably selected from benzophenone compounds, benzotriazol compounds and salicylate compounds.

The elastic synthetic polymer filament of the present invention has a specific multi-lobated cross-sectional profile, for example, as indicated in FIGS. 1A to 1F and 3.

Referring to FIGS. 1A to 1F and 3, the elastic synthetic polymer filament is composed of a filamentary axial constituent A extending along the longitudinal axis of the filament and 3 to 8, preferably 4 to 8, filamentary lobe constituents B radially protruding from and extending along the filamentary axial constituent.

Each filamentary lobe constituent B has a constricted portion C thereof through which each filamentary lobe constituent B is connected to the filamentary axial constituent A.

The cross-sectional profile of the filamentary axial constituent A is not limited to those having specific shapes. Usually, the cross-sectional profile of the filamentary axial constituent A is substantially circular as shown in FIGS. 1A to 1E, but may have an irregular cross-sectional profile, for example, a substantially polygonal shape as shown in FIG. 1F.

Figure 1C:
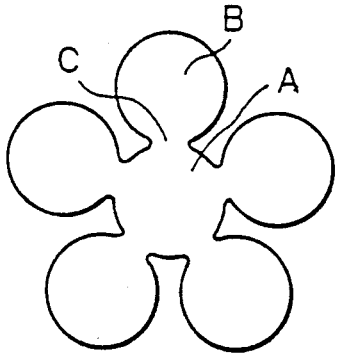
Figure 1D:
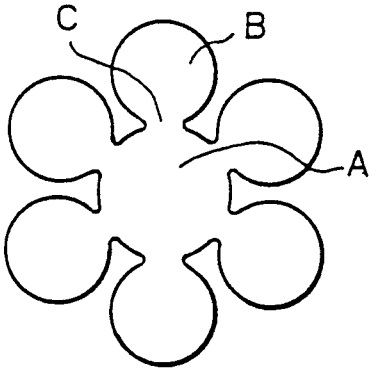
Figure 1E:
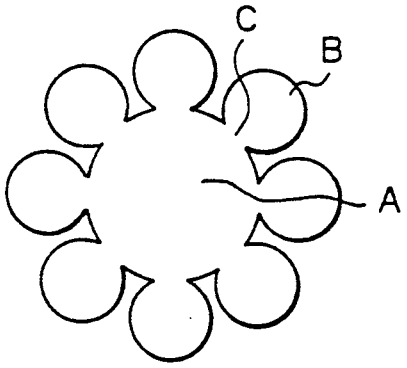
Figure 1F:
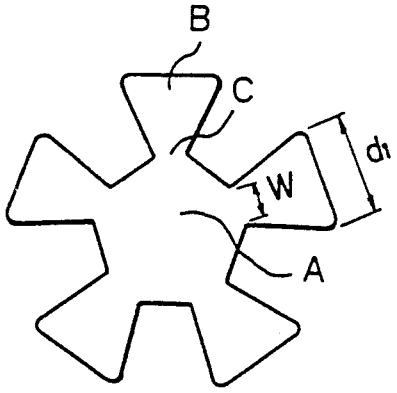

Also, the cross-sectional profile of the filamentary lobe constituents B is not restricted to those having specific shapes, but is preferably substantially circular as shown in FIGS. 1B to 1E, or is substantially a T-shape or substantially a polygonal, for example, a triangle, as shown in FIG. 1F. In the elastic synthetic polymer filament of the present invention, 3 to 8, preferably 4 to 8, of the filamentary lobe constituents B are contained. These filamentary lobe constituents B are effective for covering and protecting the filamentary axial constituent B from the chlorine-deterioration and ultraviolet ray-deterioration. The filamentary lobe constituents B are radially protruded from the filamentary axial constituent and are separate from each other.

If the number of the filamentary lobe constituents B is 2 or less, the covering effect of the filamentary lobe constituents (B) about the filamentary axial constituent becomes unsatisfactory, and the resultant filament exhibits a conventional monofilament-like high stiffness and a rigid touch.

Also, if the number of the filamentary lobe constituents (B) is 9 or more, they are frequently connected to each other, and thus the resultant filament exhibits an undesirable low softness and stiff touch, like the conventional monofilaments.

If the cross-sectional areas of the filamentary lobe constituents (B) is made small, to avoid the connection thereof with each other, the resultant filament has a large ratio of cross sectional area of the filamentary axial constituent A to the total cross-sectional area of the filamentary lobe constituents (B) becomes large, and thus exhibits a reduced softness and an increased rigidity.

As mentioned above, the 3 to 8 filamentary lobe constituents (B) must be radially protruded from the filamentary axial constituent A and separate from each other. Accordingly, in the spinning process for the filament of the present invention, it is important to prevent an undesirable contact of the filamentary lobe constituents with each other. Even if the melt-spun filamentary lobe constituents are irregularly brought into contact with each other, the occurrence of the contact should be restricted to a level of 10% or less. If the occurrence of contact is more than 10%, the resultant filament exhibits a reduced softness and a rigid touch, and is sometimes easily broken in the sewing process.

Figure 3:
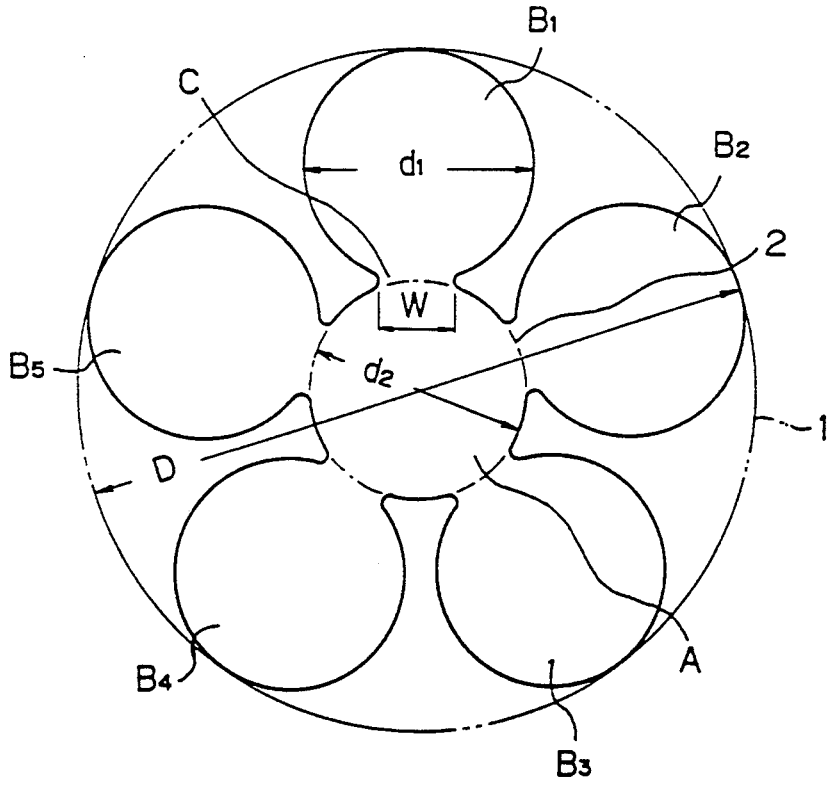

Referring to FIG. 3, the filament of the present invention is composed of a filamentary axial constituent A and 5 filamentary lobe constituents $B_1$, $B_2$, $B_3$, $B_4$ and $B_5$. Each filamentary lobe constituent ($B_1$ to $B_5$) has a constricted portion C thereof through which each filamentary constituent ($B_1$ to $B_5$) is connected to the filamentary axial constituent A.

In the filament of the present invention, the cross-sectional profile thereof satisfies the relationship (I):

$$1.3 \leqq d_1/w \leqq 10 \quad \text{(I)}$$

wherein $d_1$ represents a largest cross-sectional width of the filamentary lobe constituents (B) and w represents a smallest width of the constricted portions C of the filamentary lobe constituents (B).

Preferably, the ratio $d_1/w$ is from 1.3 to 5.0.

When the ratio $d_1/w$ is less than 1.3, the resultant elastic filament exhibits a decreased softness, a rigid touch and a lower resistance to breakage in the sewing operation by a sewing machine.

In the ratio $d_i/w$ is more than 10, the filament-formation becomes difficult and the filamentary lobe constituents are sometimes easily separated from the filamentary axial constituent. The largest width $d_1$ of the filamentary lobe constituent B and the smallest width w of the constricted portion C are measured respectively on a line drawn at a right angle to a line from the outer of gravity in the cross-section of the filamentary axial constituent A to the center of gravity in the cross-section of each filamentary lobe constituent B.

In a preferable embodiment of the elastic filament of the present invention, the cross-sectional profile of the filament satisfies the relationship (II):

$$1.8 \leqq D/d_2 \leqq 3.5 \quad \text{(II)}$$

wherein D represents a diameter of a smallest circumcircle on the cross-sectional profile of the filament and $d_2$ represents a diameter of a largest inscribed circle on the cross-sectional profile of the filamentary axial constituent.

Referring to FIG. 3, a circumcircle 1 of the cross-sectional profile of the filament has a diameter D and a inscribed circle 2 of the cross-sectional profile of the filamentary axial constituent A has a diameter $d_2$.

The ratio $D/d_2$ is preferably from 1.8 to 3.5, more preferably from 2.0 to 3.0.

When the ratio $D/d_2$ is less than 1.8, sometimes the ratio of the cross-sectional area of the filamentary axial constituent A to the total cross-sectional area of the filamentary lobe constituents B becomes too large, and thus the resultant filament has a reduced softness and a rigid touch and exhibits a lower resistance to breakage in a sewing operation by a sewing machine.

If the ratio $D/d_2$ is more than 3.5, the resultant filament sometimes exhibits an unsatisfactory resistance to photo-deterioration or the resultant filamentary lobe constituents B are frequently connected with each other.

The individual elastic filament of the present invention preferably has a denier of 10 to 100, more preferably 20 to 80.

When the denier is less than 10, the resultant elastic filament sometimes has an unsatisfactory resistance to photo-deterioration and chlorine-deterioration.

Also, a denier of more than 100 causes the resultant elastic filament to exhibit a low softness and a rigid touch.

The elastic filaments of the present invention having the multi-lobated cross-sectional profiles as shown in FIGS. 1A to 1F can be produced respectively by melt-spinning a thermoplastic elastomer through spinnerets having the multi-lobated cross-sections as indicated in FIGS. 2A to 2F.

In FIGS. 2A to 2F, each spinneret has an axial orifice 3 for forming the filamentary axial constituent A, 3 to 8 lobe orifices -4 for forming the filamentary lobe constituent B and 3 to 8 neck-shaped orifices 5 for forming the constricted portion C of the filamentary lobe constituents B.

Usually, the elastic filament of the present invention is practically used in the form of a monofilament which exhibits a high resistance to photo-deterioration and chlorine-deterioration.

If a elastic filament having a denier of about 80 or more is required, preferably it is replaced by a multifilament yarn consisting of two or more individual filaments each having a denier in the above-mentioned range.

The denier of the elastic filament and the type of filament yarn are variable, depending on the required resistance to the photo- or chlorine-deterioration and the required touch or softness.

The elastic synthetic polymer filament of the present invention can have a similar high resistance to photo- or chlorine-deterioration to that of the conventional monofilament and a higher resistance to breakage in the sewing operation than that of the conventional monofilament, if the deniers thereof are similar to each other.

Also, the elastic filament of the present invention exhibits a similar softness and touch to those of a conventional multifilament yarn, if the deniers thereof are similar to each other.

Further, the elastic filament of the present invention having the multi-lobated cross-sectional profile which is close to that of the conventional multifilament yarn is advantageous in that the filamentary constituents are connected to each other and are not separated from each other, whereas in the multifilament yarn, the individual filaments are sometimes separated from each other.

The elastic synthetic polymer filaments of the present invention are useful for swim wear, ski wear, other sports wear, and lingerie, in which the above-mentioned advantageous properties of the filament are efficiently utilized.

EXAMPLES

The specific examples presented below will more fully explain the ways in which the present invention can be practically used. It should be understood, however, that these examples are only illustrative and in no way limit the scope of the present invention.

In the examples, the following tests were carried out.

(1) Resistance to photo-deterioration

A specimen consisting of a filament yarn was exposed to a carbon arc light for the time indicated in Table 1 in accordance with the light-fastness test method of JIS L0842.

Then the tensile strength of the exposed specimen and the non-exposed specimen were measured.

The resistance of the specimen to ultraviolet ray-deterioration was represented by a retention $R_V$ of tensile strength calculated from the equation:

$$R_V(\%) = \frac{S_t}{S_{t0}} \times 100$$

wherein $S_{t0}$ represents a tensile strength of the non-exposed specimen and St represents a tensile strength of the exposed specimen.

(2) Resistance to chlorine-deterioration

A specimen consisting of an elastic filament was wound around a frame while stretching at an elongation of 20%. The stretched specimen had a length of 20 cm.

The wound specimen was immersed in a treating liquid containing chlorine in a concentration of 50 ppm, 300 ppm or 5000 ppm, at room temperature for 60 minutes, withdrawn from the treating bath, washed with water for 5 minutes, and then air-dried.

The tensile strength of the treated specimen and the non-treated specimen was then measured.

The resistance of the specimen to chlorine-deterioration was represented by a retention $R_C$ of tensile strength calculated from the equation:

$$R_C(\%) = \frac{S't}{S't_0} \times 100$$

wherein $S't_0$ represents a tensile strength of the non-treated specimen and S't represents a tensile strength of the treated specimen.

3) Breakage of ground yarns

Two pieces of a knitted fabric composed of ground yarns containing elastic filaments and having a length of 60 cm in the knitting direction and a width of 5 cm at a right angle to the knitting direction were superimposed on each other, and the superimposed specimen was sewed from a middle portion of the short side edge to a middle portion of the opposite short side edge of the specimen, in a straight line, by using a sewing machine under the following conditions.

Sewing yarn: Polyester multifilament yarn #50
Sewing needle: Slim point #9
Sewing pitch: 15 to 18 stitches/3 cm
Number of revolution: 3500±100 rpm The same operations as mentioned above were repeated three times, to provide three sewn specimens.

The same operations as mentioned above were further repeated three times, except that the specimen had a width of 5 cm in the knitting direction and a length of 60 cm at a right angle to the knitting direction.

The resultant seam portion of each sewn specimen was opened by hand, and the number of breakages of the ground yarns in the seam, excluding both the end portions of the seam to a length of 5 cm, was determined.

The number of breakages of the ground yarn was indicated by an average of the results of the 6 specimens.

4) Touch

The touch (softness) of a specimen was classified into 5 classes by an organoleptic test.

| Class | Feature |
|---|---|
| 5 | Very soft and similar to the touch of corresponding multifilaments having a circular cross-section (Comparative Example 6) |
| 4 | Soft |
| 3 | Standard (satisfactory) |
| 2 | Stiff |
| 1 | Very stiff and similar to the touch of a corresponding monofilament having a circular cross-section (Comparative Example 5) |

EXAMPLE 1

Figure 2A:
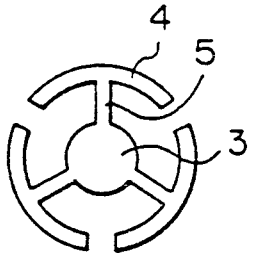
FIGS. 2A to 2F show cross-sectional profiles of spinnerets for forming the elastic synthetic polymer filaments having the cross-sectional profiles shown in FIGS. 1A to 1F; and, FIG. 3 is an enlarged view of the cross-sectional profile shown in FIG. 1C.
Figure 2B:
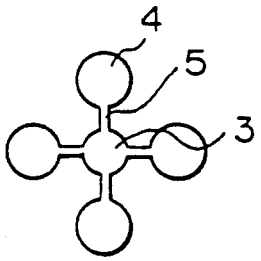
Figure 2C:
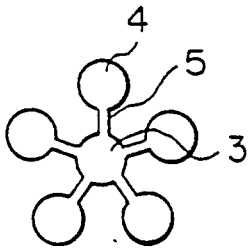
Figure 2D:
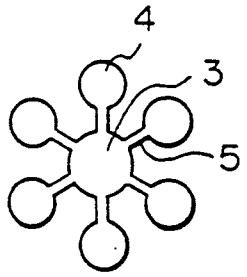
Figure 2E:
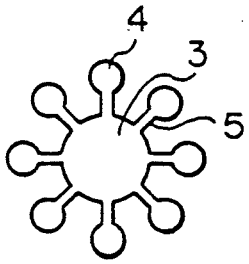
Figure 2F:
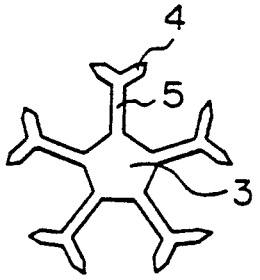

A resinous composition consisting of 100 parts by weight of a polyetherester block copolymer, which consisted of 40% by weight of hard segments consisting of a polybutylene terephthalate and 60% by weight of soft segments consisting of a polytetramethylene terephthalate, 0.2 parts by weight of a hindered amine antioxidant, and 0.2 parts by weight of a benzotriazol ultraviolet ray-absorber, was melt-extruded at a temperature of 245° C. at an extruding rate of 4.4 g/min through a spinneret having the same cross-section as shown in FIG. 2C, except that the number of lobe orifices was 3.

The resultant filament was taken up at a take-up speed of 1000 m/min through two godet rolls. The resultant filament had a yarn count of 40 denier/one filament and a cross-sectional profile as shown in FIG. 1C, except that the number of filamentary lobe constituents was 3. In the cross-sectional profile of the filament, the ratios $d_1/w$ and $D/d_2$ were as shown in Table 1.

A two-way tricot fabric having a half structure was prepared from front yarns consisting of cationic dye-dyable polyester multifilament yarns with a yarn count of 50 denier/24 filaments and back yarns consisting of the above-mentioned elastic polyetherester block copolymer yarns.

The resultant tricot fabric had a course density of 60 yarns/25.4 mm and a wale density of 24 yarns/25.4 mm.

This tricot fabric was dyed in a usual manner. The dyed tricot fabric had a course density of 107 yarns/25.4 mm, a wale density of 60 yarns/25.4 mm and a basis weight of 225 g/m$^2$.

The dyed tricot fabric was subjected to the above-mentioned tests.

The test results are shown in Table 1.

EXAMPLE 2

The same procedures as in Example 1 were carried out, except that the number of the filamentary lobe constituents was 5 and the ratios $d_1/w$ and $D/d_2$ were as shown in Table 1.

The test results are shown in Table 1.

EXAMPLE 3

The same procedures as in Example 1 were carried out, except that the number of the filamentary lobe constituents was 8 and the ratios $d_1/w$ and $D/d_2$ were as shown in Table 1.

The test results are shown in Table 1.

EXAMPLE 4

The same procedures as in Example 1 were carried out, except that the number of the filamentary lobe constituents was 5 and the ratios $d_1/w$ and $D/d_2$ were as indicated in Table 1.

The test results are shown in Table 1.

COMPARATIVE EXAMPLE 1

The same procedures as in Example 1 were carried out, except that the number of the filamentary lobe constituents was 2 and the ratios $d_1/w$ and $D/d_2$ were as shown in Table 1.

The test results are shown in Table 1.

COMPARATIVE EXAMPLE 2

The same procedures as in Example 1 were carried out, except that the number of the filamentary lobe constituents was 10 and the ratios $d_1/w$ and $D/d_2$ were as indicated in Table 1.

The test results are shown in Table 1.

COMPARATIVE EXAMPLE 3

The same procedures as in Example 1 were carried out, except that the number of the filamentary lobe constituents was 5, the ratio $d_1/w$ was 1.5, and the ratio $D/d_2$ was 2.0.

The test results are shown in Table 1.

COMPARATIVE EXAMPLE 4

The same procedures as in Example 1 were carried out, except that the number of the filamentary lobe constituents was 5, the ratio $d_1/w$ was 12.0, and the ratio $D/d_2$ was 3.3.

The test results are shown in Table 1.

COMPARATIVE EXAMPLE 5

The same procedures as in Example 1 were carried out except that the spinneret had a single circular cross-section, and thus the resultant filament was a regular monofilament having a yarn count of 40 denier/one filament.

The test results are shown in Table 1.

COMPARATIVE EXAMPLE 6

The same procedures as in Example 1 were carried out except that the spinneret comprised 6 orifices having a circular cross-section, and thus the resultant yarn was a multifilament yarn having a yarn count of 40 denier/6 filaments.

The test results are shown in Table 1.

TABLE 1

| Example No. | Item | Type of cross-sectional profile of filament | Number of filamentary lobe constituents | Ratio $d_1/w$ | Ratio $D/d_2$ | Yarn count (denier/the number of filaments | Resistance to ultra-violet rays (%) Exposure time 20 hr | 40 hr | Resistance to chlorine Chlorine concentration 50 ppm | 300 ppm | 500 ppm | Number of breakages of ground yarns per 50 cm | Touch (class) |
|---|---|---|---|---|---|---|---|---|---|---|---|---|---|
| Example | 1 | multi-lobated | 3 | 1.5 | 3.0 | 40/1 | 78 | 63 | 90 | 74 | 63 | 0 | 3 |
| | 2 | multi-lobated | 5 | 2.0 | 3.0 | 40/1 | 75 | 60 | 90 | 70 | 60 | 0 | 5 |
| | 3 | multi-lobated | 8 | 2.0 | 2.0 | 40/1 | 76 | 61 | 90 | 73 | 63 | 0 | 4 |
| | 4 | multi-lobated | 5 | 5.0 | 3.0 | 40/1 | 75 | 60 | 90 | 70 | 60 | 0 | 5 |
| Comparative Example | 1 | multi-lobated | 2 | 1.5 | 3.0 | 40/1 | 79 | 65 | 91 | 75 | 64 | 0 | 2 |
| | 2* | multi-lobated | 10 | 1.5 | 2.0 | 40/1 | 78 | 63 | 91 | 74 | 63 | 10 | 2 |
| | 3 | multi-lobated | 5 | 1.0 | 1.5 | 40/1 | 79 | 64 | 91 | 75 | 64 | 0 | 1 |
| | 4* | multi-lobated | 5 | 12.0 | 3.3 | 40/1 | 72 | 57 | 85 | 68 | 55 | 0 | 5 |

TABLE 1-continued

| Example No. | Item | Type of cross-sectional profile of filament | Number of filamentary lobe constituents | Ratio $d_1/w$ | Ratio $D/d_2$ | Yarn count (denier/the number of filaments | Resistance to ultraviolet rays (%) Exposure time 20 hr | 40 hr | Resistance to chlorine Chlorine concentration 50 ppm | 300 ppm | 500 ppm | Number of breakages of ground yarns per 50 cm | Touch (class) |
|---|---|---|---|---|---|---|---|---|---|---|---|---|---|
| | 5 | Circular | — | — | — | 40/1 | 80 | 65 | 91 | 76 | 65 | 20 | 1 |
| | 6 | Circular | — | — | — | 40/6 | 35 | 25 | 75 | 15 | 14 | 0 | 5 |

Note:
*In Comparative Examples 2 and 4, it was found that some of the filamentary lobe constituents were fuse-connected to each other. Also, in Comparative Example 4, it was found that about 20% of the total number of the filamentary lobe constituents were separated from the filamentary axial constituent.

Table 1 shows that the elastic filaments of Examples 1 to 4 in accordance with the present invention exhibited a similar resistance to ultraviolet ray-deterioration and chlorine-deterioration to those of the regular monofilament of Comparative Example 5, and a similar resistance to breakage by a sewing operation and a similar touch to those of the regular multi-filament yarn of Comparative Example 6.

Accordingly, it was confirmed that the elastic filament of the present invention with a specific multi-lobated cross-sectional profile had a satisfactory resistance to ultraviolet rays and chlorine, and to breakage by a sewing operation, and had a soft touch.

We claim:

1. An elastic polyether ester block co-polymer filament with a multi-lobated cross-sectional profile consisting of:

(A) a filamentary axial constituent extending along the longitudinal axis of the filament; and (B) 3 to 8 filamentary lobe constituents radially protruding from and extending along the filamentary axial constituent, each of said filamentary lobe constituents being connected to the filamentary axial constituent through a constricted portion, said multi-lobated cross-sectional profile of the filament satisfying the relationship (I):

$$1.3 \leqq d_1/w \leqq 10$$

wherein $d_1$ represents a largest cross-sectional width of the filamentary lobe constituents (B) and w represents a smallest cross-sectional width of the constricted portions of the filamentary lobe constituents (B).

2. The elastic polyether ester block copolymer filament as claimed in claim 1, in which the cross-sectional profile of the filament satisfies the relationship (II):

$$1.8 \leqq D/d_2 \leqq 3.5 \quad \text{(II)}$$

wherein D represents a diameter of a smallest circumcircle on the cross-sectional profile of the filament and $d_2$ represents a diameter of a largest inscribed circle on the cross-sectional profile of the filamentary axial constituent.

3. The elastic polyether ester block copolymer filament as claimed in claim 1, wherein said filament has a thickness of 10 to 100 denier.

4. The elastic polyether ester block copolymer filament as claimed in claim 1, wherein said copolymer has a melting point of from 180° C. to 240° C.

* * * * *